US005531618A

United States Patent [19]

Market

[11] Patent Number: 5,531,618

[45] Date of Patent: Jul. 2, 1996

[54] APPARATUS AND METHOD OF CONNECTING AND TERMINATING ELECTRICAL CONDUCTORS

[76] Inventor: Roger A. Market, 3108 Riverview Dr., Eau Claire, Wis. 54703

[21] Appl. No.: 72,343

[22] Filed: Jun. 4, 1993

Related U.S. Application Data

[63] Continuation of Ser. No. 912,224, Jul. 10, 1992, abandoned, which is a continuation of Ser. No. 593,314, Oct. 1, 1990, abandoned, which is a continuation of Ser. No. 358,669, May 30, 1989, abandoned.

[51] Int. Cl.[6] ..... H01R 13/33

[52] U.S. Cl. ..... 439/840; 174/87; 439/434

[58] Field of Search ..... 439/840, 841, 439/409–413, 415, 416, 428–434, 788; 174/87, 84 S; 29/857, 861

[56] References Cited

U.S. PATENT DOCUMENTS

| | | | |
|---|---|---|---|
| 2,708,266 | 5/1955 | Pavlinetz | 439/434 |
| 3,165,576 | 1/1965 | Lige | 439/840 |
| 3,717,839 | 2/1973 | Aldridge | 439/431 |
| 4,288,657 | 9/1981 | Swanson | 174/87 |
| 4,691,079 | 9/1987 | Blaha | 174/87 |

OTHER PUBLICATIONS

Ideal Industries, Inc. *From the Family of Ideal Wire–Nut Wire Connectors* . . . Form No. J–22, 1990.

"Electrical Tools and Supplies" by Ideal Industries, Inc., General Catalog 103.

"Electrical Products" by 3M, Suggested Trade Net Prices/ Jul. 1, 1987.

*Primary Examiner*—David L. Pirlot

*Attorney, Agent, or Firm*—Merchant, Gould, Smith, Edell, Welter & Schmidt

[57] ABSTRACT

The invention relates to a method and apparatus for connecting and terminating electrical conductors. The apparatus provides an electrical connector-terminal, which includes a conductive coiled spring construction that is adapted for selectively retaining and releasing a wire lead arrangement. The electrical connector-terminal further includes a terminal arrangement that is constructed and arranged for selective engagement with an electrical terminal. The method relates to a method of connecting and terminating a conductor element or wire lead arrangement to an electrical device.

18 Claims, 3 Drawing Sheets

APPARATUS AND METHOD OF CONNECTING AND TERMINATING ELECTRICAL CONDUCTORS

This is a continuation of application Ser. No. 07/912,224, filed Jul. 10, 1992, abandoned which is a continuation of prior application Ser. No. 07/593,314, filed on Oct. 1, 1990, abandoned which is a continuation of prior application Ser. No. 07/358,669, filed on May 30, 1989, now abandoned.

FIELD OF THE INVENTION

The present invention relates to a method and apparatus for connecting and terminating electrical conductors. More specifically, the present invention relates to an electrical connector-terminal construction adapted for releasably receiving and retaining a conductor or wire lead arrangement and for making electrical termination with an electrical terminal.

BACKGROUND OF THE INVENTION

In the field of electrical terminals, one known method of connecting and terminating a wire lead arrangement involves the use of a conventional crimp-on terminal. A typical crimp-on terminal provides a crimping portion for receiving and crimping a wire lead and a terminal arrangement for terminating the wire lead to an electrical terminal, for example, of an electrical device. With crimp-on terminals, a wire lead arrangement is received and crimped within the crimping portion of the terminal. While in many uses the crimp-on terminal functions fairly well, it has certain disadvantages. The crimp-on terminal's electrical termination is not really reversible, and as such, crimp-on terminals are not reusable. Furthermore, the crimping action places a relatively large amount of stress on the wire leads and can cause the wire leads to break off. Breakage, in turn, may waste the terminal and leave the electrician without enough wire to make a proper electrical termination, requiring partial or complete rewiring.

When a crimp-on terminal is used, a special crimping tool is generally required, thus requiring the electrician to carry an extra tool. At times electrical terminations must be made in places that are very hard to reach with conventional electrician tools. Furthermore, if any rewiring is needed, the use of the convention crimp-on terminal can make such electrical terminations inconvenient to reverse.

The electrical terminal field clearly has demonstrated a need for, and the present invention provides, an electrical connector-terminal: that provides an electrical termination that is easier to reverse; that is reusable; that reduces the amount of stress on the wire leads, thus reducing the chance of breaking off the leads; that readily facilitates connection and termination of multiple wires to the electrical terminal; that does not require any special tools for making the electrical connection and termination; and that reduces the amount of labor and labor related expense required for making the initial electrical termination and for any rewiring that is needed.

SUMMARY OF THE INVENTION

An electrical connector-terminal according to the invention includes an insulator construction having a bore defined therein and an open end; retaining and releasing structure adapted for selectively retaining and releasing a conductor element within the bore; a terminal arrangement adapted for selective engagement with an electrical terminal, the terminal arrangement being integral with the insulator construction; and structure for providing electrical continuity between the terminal arrangement and the conductor element.

A method according to the present invention for connecting and terminating a conductor element to an electrical device includes the step of providing a connector-terminal comprising (i) an insulator construction having a bore defined therein and an open end; (ii) retaining and releasing structure adapted for selectively retaining and releasing a conductor element within the bore; (iii) a terminal arrangement integral with the insulator construction; and (iv) conductor structure for providing electrical continuity between the terminal arrangement and the conductor element received within the bore. The method further includes the step of providing the electrical device with a terminal adapted for selective engagement with the connector-terminal's terminal arrangement. The method further includes the step of inserting the conductor element within the bore wherein the retaining and releasing structure selectively retains the conductor element within the bore. The method further includes the step of engaging the terminal arrangement with the electrical terminal.

These and various other advantages and features of novelty which characterize the invention are pointed out with particularity in the claims and annexed hereto and forming a part hereof. However, for better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
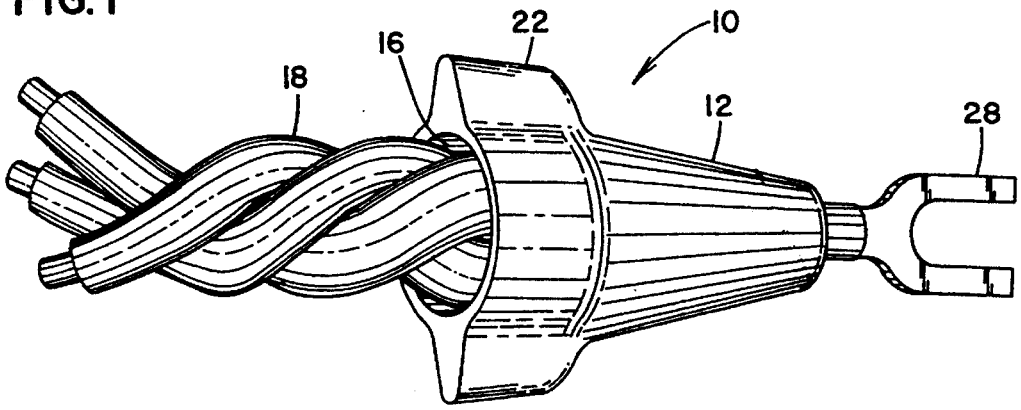
FIG. 1 is a perspective view of the electrical connector-terminal according to a preferred embodiment of the present invention and shown in operation with three wires.
Figure 2:
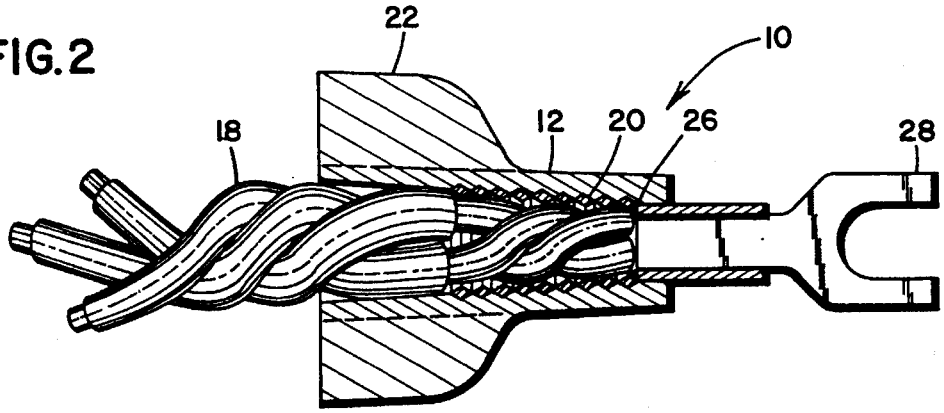
FIG. 2 is a cross sectional view of the electrical connector-terminal shown in FIG. 1.
Figure 3:
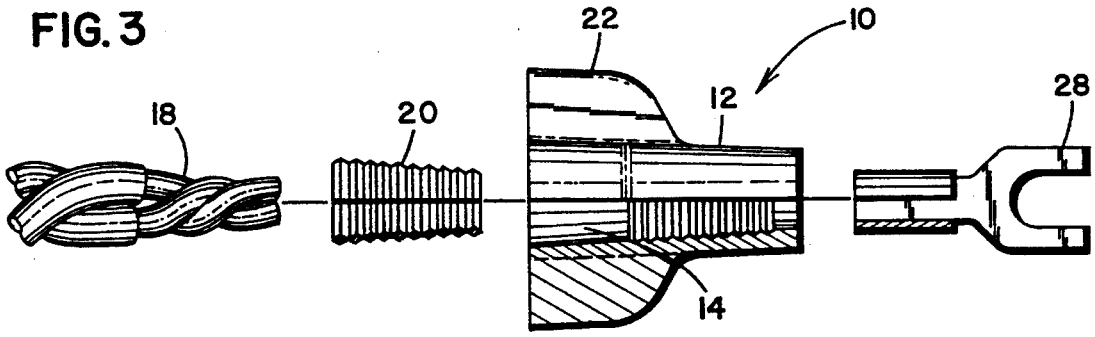
FIG. 3 is a fragmentary exploded side view of the electrical connector-terminal shown in FIGS. 1 and 2, with certain parts broken away to show internal detail.

FIGS. 1, 2, and 3 show the electrical connector-terminal 10 according to a first preferred embodiment of the present invention. As illustrated, the electrical connector-terminal 10 includes an insulator construction 12 having a bore 14 defined therein and an open end 16. The electrical connector-terminal 10 further includes a connector construction 20 for selectively retaining and releasing wire leads 18. The connector construction 20 is received within the bore 14 of the insulator construction 12. The electrical connector-terminal further includes a terminal arrangement 28 for selective engagement with an electrical terminal, for example, the electrical terminal of an electrical device. The terminal arrangement 28 is non-removably mounted in association with the insulator construction 12. The electrical terminal arrangement further includes conductor means for providing electrical continuity between the terminal arrangement 28 and the wire lead 18. Preferably, the connector construction 20 includes a conductive material, and thus also provides the means for making electrical continuity between the terminal arrangement 28 and the wire lead 18. However, it should be understood that the connector construction and the means for making electrical continuity could be independent structure. As shown in FIGS. 2 and 3, the connector construction 20 is a conductive coiled spring construction of the type used in wire nut type connectors.

Referring again to FIGS. 1, 2, and 3, preferably the insulator construction 12 is made from a rigid high impact resistant polypropylene material which gives the connector-terminal excellent chemical resistance. Also, the insulator construction 12 preferably includes gripping arrangement for enhancing the grip and leverage on the insulator construction's outer surface. As shown in the drawings, the gripping arrangement includes a pair of wings 22 extending from the outer surface of the insulator construction 12. The gripping arrangement could also include fluted or oval shaped structure adapted for enhancing leverage to the insulator construction's outer surface. With the pair of wings 22, the wires can be tightened within the connector-terminal without the need for an additional tool.

It should be understood that the insulator construction 12 could include a variety of different shapes and configurations. However, preferably the insulator construction is an elongate construction having an elongate bore and an open end 16 for receiving the wire lead arrangement 18.

Referring now to FIGS. 2 and 3, the connector construction 20 preferably includes a conductive coiled spring construction which is received within the bore 14 of the insulator construction 12. The terminal arrangement 28 is non-removably mounted to the conductive coiled spring construction 20. A brazing method (the joining of two metal parts with a suitable melted copper-alloy, which ensures a low resistance yet solid connection) could be used to non-removably mount the terminal arrangement 28 to the conductive coiled spring construction 20. As an alternative, the terminal arrangement 28 could be formed continuous with the conductive coiled spring construction 20, thus forming a unitary construction and eliminating the need to electrically bond, i.e., by brazing, the two components together. The conductive coiled spring construction 28 could include a squared edge conductive coil spring construction. The squared edges of the coiled spring draws the wire leads into the connector and bites into the wire leads, thus ensuring a good electrical connection.

Figure 4:
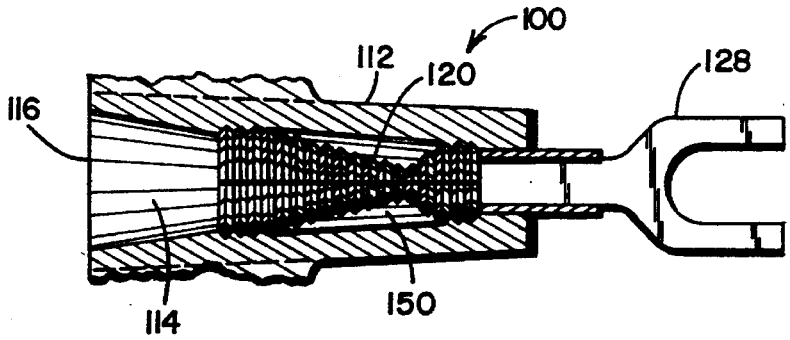
FIG. 4 is a partial cross sectional view of an alternative embodiment of the electrical connector-terminal.

FIG. 4 shows an alternative embodiment of an electrical connector-terminal 100 that generally embodies the features of the electrical connector-terminal 10 shown in FIGS. 1, 2, and 3. As illustrated, the electrical connector-terminal 100 includes an insulator construction 112 having a bore 114 defined therein and an open end 116. The electrical connector-terminal 100 further includes a connector construction 120 for selectively retaining and releasing a wire lead arrangement. The electrical connector-terminal 100 further includes a terminal arrangement 128 for selective engagement with an electrical terminal. The terminal arrangement 128 is non-removably mounted in association with the insulator construction 112. The electrical connector-terminal 100 further includes conductor means for providing electrical continuity between the terminal arrangement 128 and the wire lead arrangement. As shown in FIG. 4, the connector construction 120 is a conductive coiled spring construction that is free to expand into expansion area 150 as the wire lead arrangement is drawn into the electrical connector-terminal 100. The expansive conductive coiled spring construction provides the electrical connector-terminal with better holding power over a wide range of wire combinations.

Figure 5:
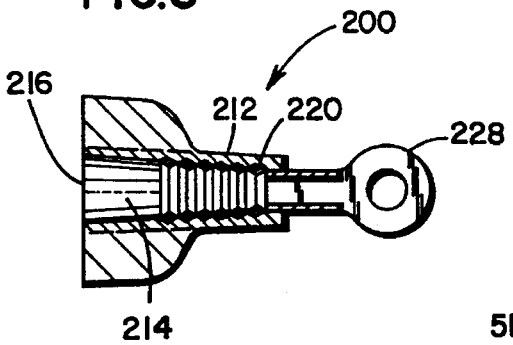
FIGS. 5 is a cross sectional view, analogous to FIG. 2, of an alternative embodiment of the electrical connector terminal.

FIG. 5 shows an alternative embodiment of an electrical connector-terminal 200 that generally embodies the features of the electrical connector-terminal 10 shown in FIGS. 1, 2, and 3. As illustrated, the electrical connector-terminal 200 includes a conductive coiled spring construction 220 adapted for selectively retaining and releasing a wire lead arrangement. The electrical connector-terminal 200 further includes a ring-type terminal arrangement which is preferably formed continuous with the conductive coiled spring construction. The ring-type terminal arrangement may also be non-removably mounted to conductive coiled spring construction 220, for example, by brazing. The electrical connector-terminal 200 further includes an insulator construction 212 having a bore 214, and an open end 216 for receiving the conductive coiled spring construction 220 within the bore 214.

Figure 6:
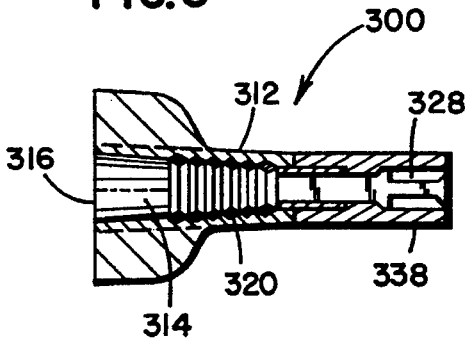
FIG. 6 is a cross sectional view, analogous to FIG. 2, of an alternative embodiment of the electrical connector-terminal.

FIG. 6 shows an alternative embodiment of an electrical connector-terminal 300 that generally embodies the features of the electrical connector-terminal 10 shown in FIGS. 1, 2, and 3. As illustrated, the electrical connector-terminal 300 includes a conductive coiled spring construction 320 adapted for selectively retaining and releasing a wire lead arrangement. The electrical connector-terminal 300 further includes an insulated female spade-type terminal arrangement 328. Typically, the female spade-type terminal is adapted for selective engagement with a typical male-type terminal. Insulation material 338 fully encloses the spade-type terminal arrangement 328. The female spade-type terminal 328 is non-removably mounted to or formed continuous with the conductive coiled spring construction 320. The electrical connector-terminal 300 further includes an insulator construction 312 having a bore 314 and an open end 316 for receiving the conductive coiled spring construction 320 within the bore.

Figure 7:
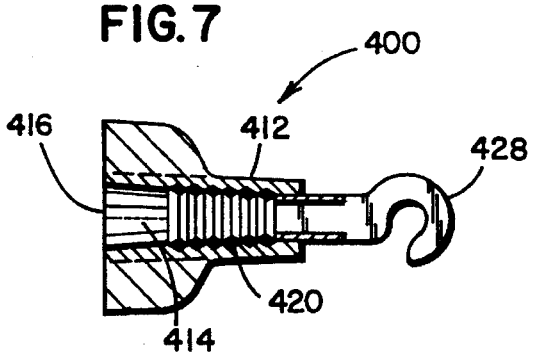
FIG. 7 is a cross sectional view, analogous to FIG. 2, of an alternative embodiment of the electrical connector-terminal.

FIG. 7 shows an alternative embodiment of an electrical connector-terminal 400 that generally embodies the features of the electrical connector-terminal 10 shown in FIGS. 1, 2, and 3. As illustrated, the electrical connector-terminal 300 includes a conductive coiled spring construction 320 adapted for selectively retaining and releasing a wire lead arrangement. The electrical connector-terminal 300 further includes a hook-type terminal arrangement 428 constructed and arranged for selective engagement with an electrical terminal. The hook-type terminal arrangement is non-removably mounted to or formed continuous with the conductive coiled spring construction 420. The electrical connector-terminal 400 further includes an insulator construction 412 having a bore 414 and an open end 416 for receiving the conductive coiled spring construction 420 within the bore.

Figure 8:
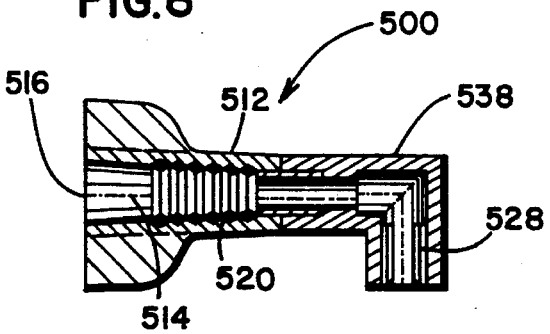
FIG. 8 is a cross sectional view, analogous to FIG. 2, of an alternative embodiment of the electrical connector-terminal.

FIG. 8 shows an alternative embodiment of an electrical connector-terminal 500 that generally embodies the features of the electrical connector-terminal 10 shown in FIGS. 1, 2, and 3. As illustrated, the electrical connector-terminal includes a conductive coiled spring construction 520 adapted for selectively retaining and releasing a wire lead arrangement. The electrical connector-terminal 500 further includes a right angle female spade-type terminal arrangement 528 for selective engagement with a suitable male-type terminal arrangement. Insulation material 538 fully encloses the spade-type terminal arrangement 528. The right angle female spade terminal arrangement is non-removably mounted to or formed continuous with the conductive coiled spring construction 520. The electrical connector-terminal 500 further includes an insulator construction 512 having a bore 514 and an open end 516 for receiving the conductive coiled spring construction 520 within the bore.

Figure 9:
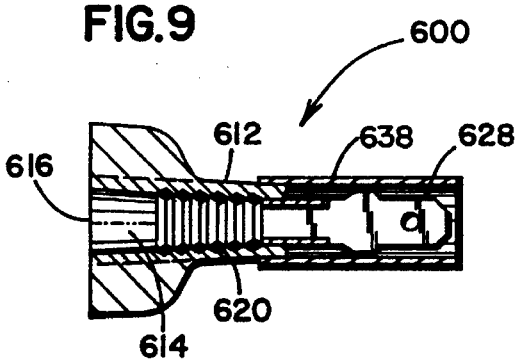
FIG. 9 is a cross sectional view, analogous to FIG. 2, of an alternative embodiment of the electrical connector-terminal.

FIG. 9 shows an alternative embodiment of an electrical connector-terminal 600 that generally embodies the features of the electrical connector-terminal 10 shown in FIGS. 1, 2, and 3. As illustrated, the electrical connector-terminal 600 includes a conductive coiled spring construction 620 adapted for selectively retaining and releasing a wire lead arrangement. The electrical connector-terminal 600 further includes an insulated male-type terminal arrangement adapted for electrical engagement with a suitable female-type terminal arrangement. Insulation material 638 fully encloses the spade-type terminal arrangement 628. The electrical connector-terminal 600 further includes an insulator construction 612 having a bore 614 and an open end 616 for receiving the conductive coiled spring construction 620 within the bore.

Figure 10:
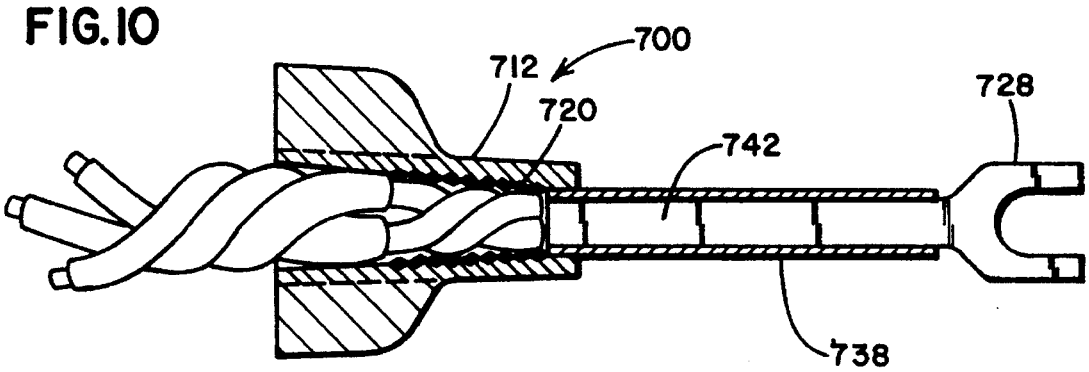
FIG. 10 is a cross sectional view, analogous to FIG. 2, of an alternative embodiment of the electrical connector-terminal.

FIG. 10 shows an alternative embodiment of an electrical connector-terminal 700 that generally embodies the features of the electrical connector-terminal 10 shown in FIGS. 1, 2, and 3. As illustrated, the electrical connector-terminal 700 includes a conductive coiled spring construction 720 adapted for selectively retaining and releasing a wire lead arrangement. The electrical connector-terminal 700 further includes a terminal arrangement 728 which includes a flexible shaft 742 which permits termination in diverse situations. The flexible shaft 742 is non-removably mounted to or formed continuous with the conductive coiled spring construction 720. The electrical connector-terminal 700 further includes an insulator construction 712 analogous to those previously describe herein.

Figure 11:
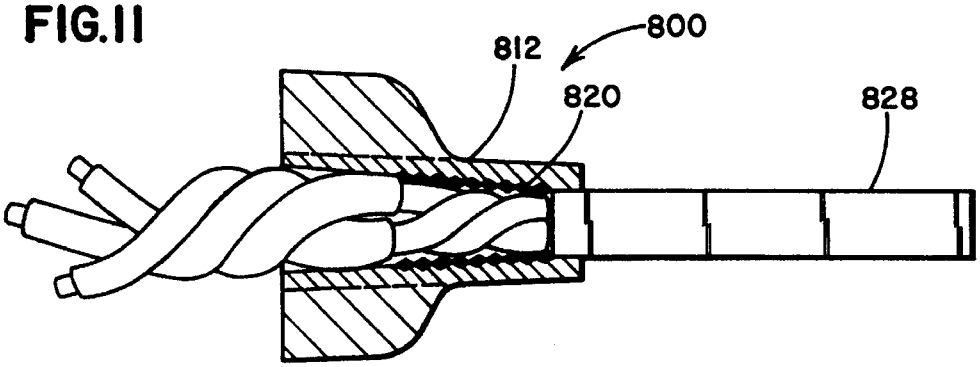
FIG. 11 is a cross sectional view, analogous to FIG. 2, of an alternative embodiment of the electrical connector-terminal.

FIG. 11 shows an alternative embodiment of an electrical connector-terminal 800 that generally embodies the features of the electrical connector-terminal 10 shown in FIGS. 1, 2, and 3. As illustrated, the electrical connector-terminal 800 includes a conductive coiled spring construction 820 adapted for selectively retaining and releasing a wire lead arrangement. The electrical connector-terminal 800 further includes a terminal arrangement 828 which includes a flexible shaft 842, for example, a current carrying rod or non-insulated flexible shaft. The flexible shaft 842 is non-removably mounted to or formed continuous with the conductive coiled spring construction 820. The electrical connector-terminal 800 further includes an insulator construction 812 analogous to those previously describe herein.

Figure 12:
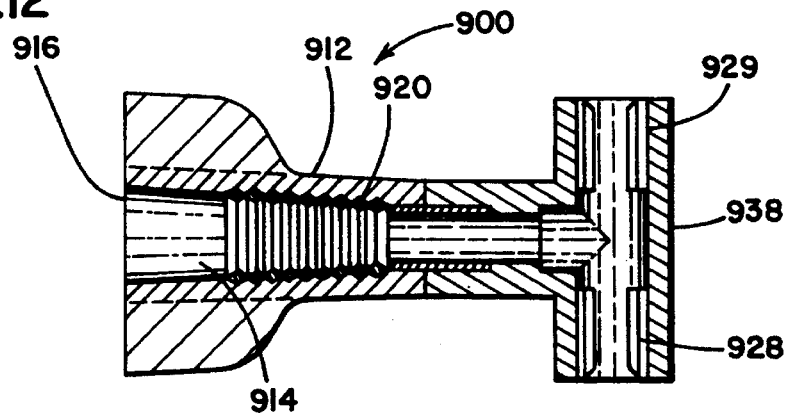
FIG. 12 is a cross sectional view, analogous to FIG. 8, of an alternative embodiment of the electrical connector-terminal.

FIG. 12 shows an alternative embodiment of an electrical connector-terminal 900 that generally embodies the features of the electrical connector-terminal 10 shown in FIGS. 1, 2, and 3. As illustrated, the electrical connector-terminal includes a conductive coiled spring construction 920 adapted for selectively retaining and releasing a wire lead arrangement. The electrical connector-terminal 900 further includes a dual terminal arrangement 928, 929 for selective engagement with suitable terminal arrangements of an electrical device. The dual terminal arrangement 928, 929 permits multiple termination. Insulation material 938 fully encloses the spade-type terminal arrangements 928, 929. The terminal arrangement is non-removably mounted to or formed continuous with the conductive coiled spring construction 920. The electrical connector-terminal 900 further includes an insulator construction 912 having a bore 914 and an open end 916 for receiving the conductive coiled spring construction 920 within the bore.

Although not shown in the drawings, an alternative embodiment of electrical connector-terminal 10 could feature an insulator construction 12 which includes a removable insulator construction.

The method according to the invention provides an improved and more efficient way to electrically connect and terminate a conductor element or wire lead arrangement to an electrical device. The method includes the step of providing an electrical connector-terminal of the type described herein. The method further includes the step of providing the electrical device with an electrical terminal constructed and arrangement for selective engagement with the electrical connector's terminal arrangement. The method further includes the step of inserting the conductor element within the connector-terminal's bore wherein the connector construction selectively retains the conductor element within the bore. The method further includes the step of engaging the terminal arrangement with the electrical terminal.

It is to be understood that, even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector-terminal comprising:

(a) a rigid insulator construction having a bore defined therein and an open end;

(b) a conductive coiled spring received with the bore, said spring adapted for selectively retaining and releasing a conductor element within the bore;

(c) a electrical connector-terminal adapted for selective engagement with an electrical terminal, said connector-terminal being non-removably mounted on said insulator construction, and said connector-terminal being non-removably mounted on and in direct contact with said conductive coiled spring; and (d) conductor means adapted for providing electrical continuity between said connector-terminal and the conductor element.

2. The electrical connector-terminal according to claim 1, wherein said insulator construction includes gripping means which is adapted for enhancing grip and leverage on an outer surface of said insulator construction.

3. The electrical connector-terminal according to claim 1, wherein said insulator construction comprises an elongate body, the bore defined therein being elongate.

4. The electrical connector-terminal according to claim 1, wherein said conductive coiled spring comprises a squared-edged conductive coiled spring.

5. The electrical connector-terminal according to claim 1, wherein portions of said conductive coiled spring are free to expand within the bore to provide holding power over a wide range of wire combinations.

6. The electrical connector-terminal according to claim 1, wherein said terminal arrangement is brazed to said conductive coiled spring.

7. The electrical connector-terminal according to claim 1, wherein said terminal arrangement comprises a fork-type terminal arrangement.

8. The electrical connector-terminal according to claim 1, wherein said terminal arrangement comprises a hook-type terminal arrangement.

9. The electrical connector-terminal according to claim 1, wherein said terminal arrangement comprises a ring-type terminal arrangement.

10. The electrical connector-terminal according to claim 1, wherein said terminal arrangement comprises a female spade-type terminal arrangement.

11. The electrical connector-terminal according to claim 1, wherein said terminal arrangement comprises a male spade-type terminal arrangement.

12. The electrical connector-terminal according to claim 1, wherein said terminal arrangement comprises an insulated spade-type terminal arrangement.

13. The electrical connector-terminal according to claim 1, wherein said terminal arrangement comprises a conductive rod.

14. The electrical connector-terminal according to claim 13, wherein said conductive rod comprises a flexible structure.

15. The electrical connector-terminal according to claim 1, wherein said terminal arrangement comprises a flexible shaft.

16. The electrical connector-terminal according to claim 15 wherein said flexible shaft is insulated.

17. An electrical connector-terminal comprising:

(a) a conductive coiled spring adapted for selectively retaining and releasing a conductor element;

(b) a electrical connector-terminal adapted for selective engagement with an electrical terminal, said connector-terminal being non-removably mounted on and in direct contact with said conductive coiled spring; and (c) a rigid insulator construction having a bore defined therein and an open end communicating with the bore said conductive coiled spring being received within the bore, said connector-terminal being non-removably mounted on said insulator construction.

18. A method of connecting and terminating a conductor element to an electrical device, the method comprising the steps of:

(a) providing an electrical connector-terminal comprising:

(i) a rigid insulator construction having a bore defined therein and an open end communicating with the bore;

(ii) a conductive coiled spring received with the bore, said spring adapted for selectively retaining and releasing a conductor element within the bore;

(iii) a electrical connector-terminal being non-removably mounted on said insulator construction, and said connector-terminal being non-removably mounted on said conductive coiled spring;

(iv) conductor means adapted for providing electrical continuity between said terminal arrangement and the conductor element;

(b) providing the electrical device with an electrical terminal adapted for selective engagement with the electrical connector's terminal arrangement;

(c) inserting the conductor element within the bore wherein the conductive coiled spring selectively retains the conductor element within the bore; and (d) engaging the connector-terminal with the electrical terminal.

* * * * *